United States Patent [19]

Koike

[11] 4,262,396

[45] Apr. 21, 1981

[54] BUCKLE ASSEMBLY FOR VEHICLE SEAT BELT

[75] Inventor: Kiyokazu Koike, Fujisawa, Japan

[73] Assignee: NSK-Warner K. K., Tokyo, Japan

[21] Appl. No.: 55,956

[22] Filed: Jul. 9, 1979

[30] Foreign Application Priority Data

Jul. 10, 1978 [JP] Japan ..... 53/93919[U]
Sep. 28, 1978 [JP] Japan ..... 53/133224[U]

[51] Int. Cl.[3] ..... A44B 11/26; A44B 19/00
[52] U.S. Cl. ..... 24/230 AL
[58] Field of Search ..... 24/230 AL, 230 R, 230 AK, 24/230 A

[56] References Cited

U.S. PATENT DOCUMENTS

| | | | |
|---|---|---|---|
| 2,882,581 | 4/1959 | Spielman | 24/230 R |
| 3,522,640 | 8/1970 | Lohr | 24/230 AL |
| 3,675,281 | 7/1972 | Stephenson | 24/230 AL |
| 3,807,000 | 4/1974 | Weman | 24/230 AL |
| 3,877,115 | 4/1975 | Quinting et al. | 24/230 AL |
| 4,181,832 | 1/1980 | Ueda | 24/230 AL |

*Primary Examiner*—Alexander Grosz
*Attorney, Agent, or Firm*—Shapiro and Shapiro

[57] ABSTRACT

A buckle assembly for a vehicle seat belt includes cover members, locking means, and locking member operating means. The locking means comprises a base member, a locking member, and biasing means for biasing the locking member toward its locking position, and these members may be assembled together by successively putting them on the cover member. The locking member operating means includes a push button slideably mounted between the cover members. The locking member may include a lever member for transmitting the slide movement of the push button to the locking member.

8 Claims, 15 Drawing Figures

BUCKLE ASSEMBLY FOR VEHICLE SEAT BELT

BACKGROUND OF THE INVENTION

1. Field of the Invention

The present invention relates to a buckle assembly for vehicle seat belt and is more particularly directed to improvements in such a buckle assembly.

2. Description of the Prior Art

Various improvements have been proposed for buckle assemblies for vehicle seat belt. All of the known buckle assemblies for vehicle seat belt have a common basic structure comprising a tongue and a locking mechanism for locking the tongue in a predetermined position. The locking mechanism or device generally includes a base member, a locking member normally biased in its tongue locking direction by bias means disposed in the base member, operating means for actuating the locking member and cover means for enclosing and supporting all of the members. One of the most important problems involved in the buckle assembly of the above structure is found in assembling. All of the structural members must be assembled together properly between the base and cover so as to form a buckle assembly easily and conveniently operable. However, structural members and parts of the known buckle assembly are complicated in form and structure and they each need manual work in assembling. This is laborious and time consuming and therefore the manufacturing cost becomes high. In addition, the products lack uniformity and the operability thereof is not so good.

Another problem is found in the position at which locking member operating means must be mounted. Means for operating the locking member is usually composed of a push button directly engaged with the locking member and being manually operative such as with the operator's finger. Since the push button is to be engaged directly with the locking member, the former has to be mounted in the vicinity of the latter, which limits the freedom of the push button mounting position. It is not always allowable, therefore, to dispose the exposed surface part of the push button in a position convenient for the operator to push the exposed surface part with his finger. This makes the operability of the push button unsatisfactory. Furthermore, since the force applied to the push button by the operator is directly used to operate the locking member, the unlocking and disconnecting action of the buckle assembly may be done only in an unsatisfactory manner.

SUMMARY OF THE INVENTION

Accordingly, it is an object of the present invention to provide a buckle assembly for a vehicle seat belt which is composed of those essential elements and members which are simple in form and structure and easy to manufacture and assemble.

It is another object of the invention to provide a buckle assembly for a vehicle seat belt which can be conveniently assembled by a sequence of assembly steps suitable not only for a simple manual assembling process but also for an automatic assembly process.

It is a further object of the invention to provide a buckle assembly for a vehicle seat belt which is easy to operate, which allows greater freedom in the mounting position of the push button by interposing a lever member between the locking member and the push button, and which is improved also in the operability and disengageability of the assembly.

Other and further objects, features and advantages of the invention will appear more fully from the following description taken in connection with the accompanying drawings.

DETAILED DESCRIPTION OF THE PREFERRED EMBODIMENTS

Figure 1:
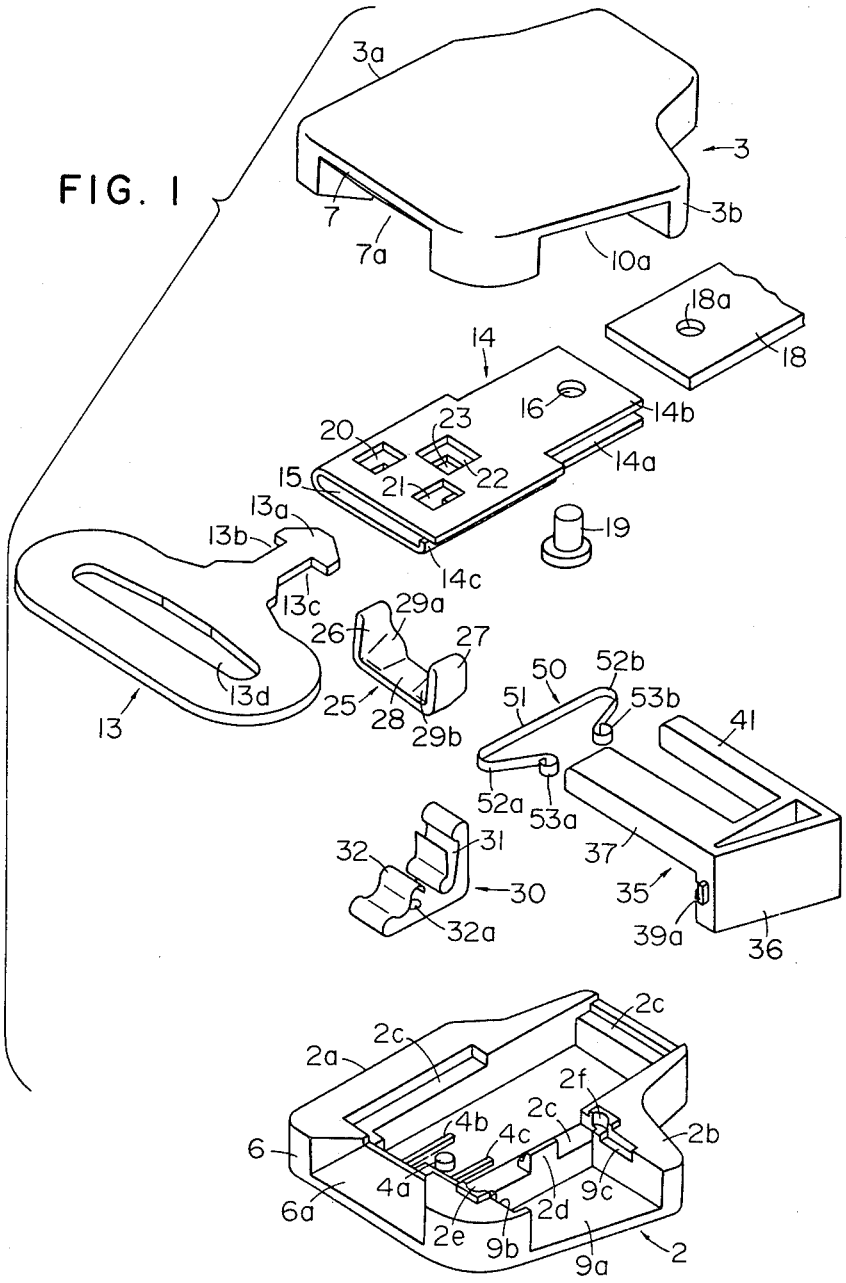
FIG. 1 is an exploded, perspective view of a buckle assembly showing a first embodiment of the invention.

Referring first to FIGS. 1 to 5 showing a first embodiment of the invention, a locking device used in the buckle assembly for vehicle seat belt according to the invention is generally designated by 1. The locking device 1 has an lower cover 2 and an upper cover 3 in a somewhat rectangular form. When assembled together, the two cover members 2 and 3 form a box-like case in which there is defined a hollow room or chamber 5 to receive various elements as hereinafter described. The cover members have cutouts 7*a* and 6*a* provided in the walls 7 and 6 respectively at the foreside (left-hand side as viewed in FIG. 1) of the covers. When the two covers are assembled, these cutouts 7*a* and 6*a* together form a tongue inserting opening 8 (FIG. 4) which is in communication with the above mentioned room 5. Two long side walls of the cover 3 are designated by 3*a* and 3*b*, and two long side walls of the cover 2 are designated by 2*a* and 2*b*, of which the long side walls 3*b* and 2*b* have cutouts 10*a* and 9*a* respectively. The two mating cutouts 10*a* and 9*a* together form an opening 11 (FIG. 5) for receiving a push button.

At the insides of the upper and lower covers 3 and 2 there are provided horizontally stepped portions 3*c* and 2*c* and a platform portion 3*d* to support a base member 14 to be laid on these portions, as will be described later. The base member 14 comprises two flat plates 14*a* and 14*b* extending parallel to each other. These two parallel flat plates 14*a* and 14*b* are formed by bending a single sheet of metal in such manner as to form a tongue introducing space 15 therebetween, as best seen in FIG. 1. When the base member 14 is correctly positioned on the above-mentioned supporting portions in the inner room 5 defined by the two cover members, the space 15 is in communication with the tongue inserting opening 8. The space 15 is sized to receive the tongue 13. The parallel flat plates 14*a* and 14*b* have, at their rear end portions, circular bores 16 respectively which are vertically aligned with each other. A connection part 18 for connecting the locking device to a part of the vehicle body or the like also has a bore 18*a* which is aligned with the bores 16 when the connection part 18 is inserted into the space 15 from the rear end side of the base member 14. In the aligned position, the connection part 18 is riveted to the base member 14 by a rivet 19 passing through the bores 16 and 18*a*. Of course, the connection of the base member 14 to the vehicle body or other portion may be carried out in different manner from that shown in this embodiment. For example, webbing, flexible wire and iron plate also may be used for this purpose.

The upper flat plate part 14*b* of the base member 14 has three square openings 20, 21 and 22 of which two square openings 20 and 21 are disposed laterally aligned to each other in the vicinity of the fore end of the plate 14*b*. The last one 22 is disposed rearwardly spaced from the two openings 20 and 21 and is located nearly in the middle area of the flat plate 14*b*. The first mentioned two square openings 20 and 21 serve as guide slots for a locking member, as described hereinafter, and the last mentioned square opening 22 allows the vertical portion 31 of a leaf spring 30 to pass through it without interference. On the other flat plate part of the base member 14, namely on the lower flat plate 14*a*, there is provided a larger opening 23 having a size corresponding to all of the three openings 20, 21 and 22 formed in the upper plate 14*b*.

A locking member 25 is slideably received in these openings. The locking member 25 is generally U-shaped as shown in FIG. 1, and comprises two leg portions 26 and 27 and a connection portion 28 extending between the lower ends of the leg portions 26 and 27. The connection portion 28 is under the biasing force of the leaf spring 30 which normally biases the locking member upwardly. The leaf spring 30 is formed by bending a thin plate several times into the shape illustrated, and comprises a three-layer vertical part 31 and a double-layer horizontal part 32. The vertical part 31 biases the tongue 13 back out of opening 8, whereas the horizontal part 32 biases the locking member upward as mentioned above. The bottom layer of the horizontal part 32 has a bore 32*a* provided therein into which a projection 4*a* formed on the inside surface of the lower cover member 2 is engaged. In addition to the pin-like projection 4*a*, the lower cover member 2 has two elongated projections 4*b* and 4*c* extending in parallel to each other at the both sides of the pin-like projection 4*a*. These elongated projections serve to hold the bottom layer of the leaf spring along its sides. The engagement of the projections 4*a*, 4*b* and 4*c* with the bore 32*a* and the both long sides of the bottom layer of the horizontal part 32 secure the leaf spring 30 to the inside surface of the lower cover member 2. Furthermore, when the upper and lower cover members are assembled together, the folded top portion of the vertical part 31 of the leaf spring is fitted into a slot 3*e* formed on the platform portion 3*d* of the upper cover member 3.

The two corner portions contiguous to the legs 26 and 27 of the locking member 25 protrude upwardly to form locking portions 29*a* and 29*b*, each having a front sloped surface serving as a cam surface and a rear vertical surface serving as a locking engagement surface.

When the tongue 13 with an anchoring fore end 13*a* is inserted into the space 15 between the parallel flat plates 14*a* and 14*b* of the base member through the tongue inserting opening 8 (FIG. 4), the fore end 13*a* of the tongue at first comes into contact with the sloped cam area of the locking member 25 and pushes the latter down so as to allow the further insertion of the tongue. After the fore end 13*a* has passed the cam area and when the cutout portions 13*b* and 13*c* forming a narrow neck part of the tongue come to the position just above the locking portions 29*a* and 29*b* of the locking member, the latter is allowed to move upward up to its original position under the action of the leaf spring 30. Thus, the rear vertical locking engagement surfaces of the locking portions 29*a* and 29*b* come into engagement with the backside surface of the inserted anchoring fore end 13*a* to accomplish locking of the tongue 13. To this end, the width of the fore end 13*a* of the tongue is smaller than the distance between the two legs 26 and 27 of the locking member 25 and the width of the neck part of the tongue is smaller than the minimum distance between the two locking portions 29*a* and 29*b*.

Generally designated by 35 is a push button which is contained in a space defined by the cutouts 10*a* and 9*a* in the upper and lower covers 3 and 2 and the platform portion 3*d* in the upper cover 3. The push button 36 comprises an inclined surface portion 36 and two leg portions 37 and 41 extending parallel with each other with a certain space therebetween. When assembled, the inclined surface portion 36 is received in the opening 11 formed by the two cutouts 10*a* and 9*a* so that it may be touched by the operator's finger or the like for operating the push button 35. The two leg portions 37 and 41 extend in a direction essentially normal to the direction in which the tongue is inserted and are received in long spaces provided on the both sides of the platform portion 3*d* with one leg portion being along the one long side of the platform and the other leg portion along the opposite long side of the platform. As the platform portion 3*d* is sandwiched in between the two parallel leg portions 37 and 41, the push button 35 can be slid along the both long sides of the platform portion 3*d* smoothly without ricketiness.

The push button 35 is normally biased in a direction normal to the tongue inserting direction and outwardly by a spring 50. The spring 50 comprises a straight line portion 51, curved portions 52*a* and 52*b* and circular end portions 53*a* and 53*b*. When assembled, the straight portion 51 is held sandwiched in between the inside surface of a projection 2*d* and the curved side end surface 14*c* of the flat plate 14*a* of the base member 14. The projection 2*d* is formed on the stepped portion 2*c* of the lower cover member 2, said stepped portion extending across the cutout 9*a*. The curved portions 53*a* and 53*b* of the spring are fitted in curved recesses 2*e* and 2*f* formed on the inner side walls of the cutout 9*a*. The two end circular portions 53*a* and 53*b* are fitted in a recess 38 (FIG. 2) formed on the central area of the inside wall of the inclined portion 36 of the push button 35. As the push button biasing spring 50 is positioned and held in the position in this manner, the spring 50 can be flexed by a pressure to push the button down. The pressure makes the both leg parts of the spring contact the straight line portion 51, which produces a spring force tending to move the push button back outward. Therefore, when the push button 35 is released from pushing by finger, it is returned back to its starting position by the restoring force of the spring 50. The stroke of the push button is limited by projections 39*a* and 39*b* engaged in slots formed by notches 9*b*, 10*b* and 9*c*, 10*c* in the upper and lower cover members 3 and 2.

Figure 2:
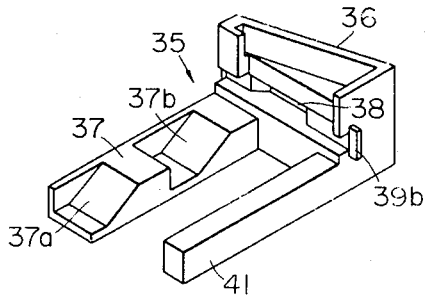
FIG. 2 is a perspective view of a push button shown in FIG. 1 showing the structure of the backside of the button in detail.
Figure 3:
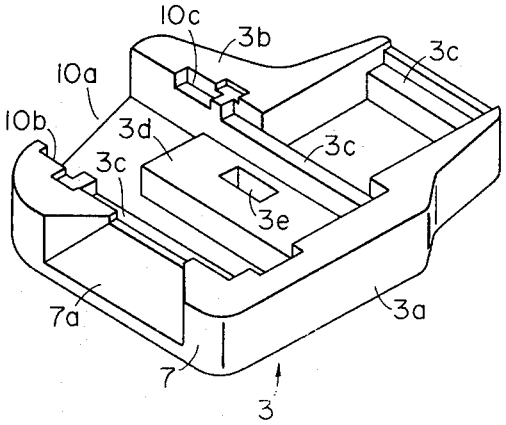
FIG. 3 is a perspective view of an upper cover member shown in FIG. 1 showing the structure of the inside of the cover member in detail.

As seen in FIG. 2, the push button 35 has two cam surfaces 37*a* and 37*b* provided on the underside surface of the foreleg portion 37. The cam surfaces are inclined in the direction of the sliding movement of the push button and disposed to contact the top ends of the leg portions 26 and 27 of the locking member 25, respectively, so as to operate the locking member. When the push button 35 is pushed, the locking member 25 is moved down against the force of the leaf spring 30 through the cam action of the cam surfaces. When the push button 35 is returned to its starting position, the locking member 25 is allowed to move back upwardly to its starting position.

At the end opposite to the above described anchoring fore end part 13*a*, the tongue 13 has an enlarged rear part having an opening 13*d* used for connecting a webbing not shown. In the above described locked position, the tip end of the anchoring fore part 13*a* is in contact with the vertical part 31 of the leaf spring 30 by which pressure the vertical part 31 is compressed (FIG. 4*c*). Because of the spring 30 being compressed in this manner, the tongue 13 is pushed out automatically by the restoring force of the spring when lock is released.

The manner of operation of the above described first embodiment apparatus will be described with reference to FIGS. 4 and 5.

Figure 4A:
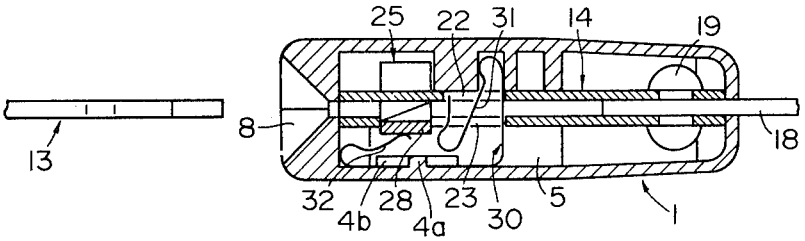
FIGS. 4*a* to 4*c* illustrate the manner of operation of the first embodiment in longitudinal section with the push button being omitted.

In the position shown in FIG. 4*a*, the tongue and locking device are separated from each other. In this position, the locking member 25 of the locking device 1 is held in its uppermost position by the leaf spring 30 in contact with the underside surface of the connection part 28 of the locking member 25. The locking portions 29*a* and 29*b* of the locking member 25 are at the same level as the space 15 between the two parallel flat plates 14*a* and 14*b* of the base member 14.

Figure 4B:
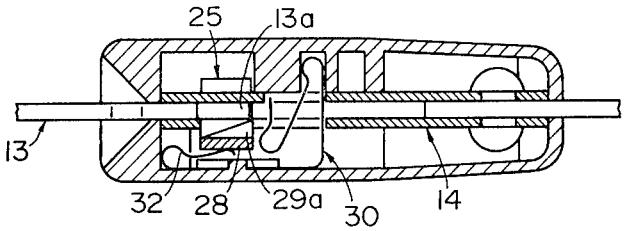
Figure 4C:
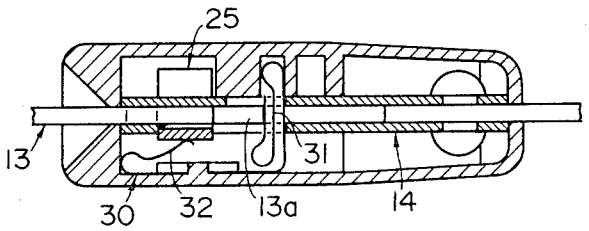

From the above separated position, the tongue 13 may be inserted into the locking device 1 through the tongue inserting opening 8 in the manner shown in FIG. 4*b*. At the first step of insertion of the tongue 13 into the locking device 1, as previously described, the fore end part 13*a* of the tongue comes into contact with the sloped cam area of the locking portions 29*a* and 29*b* so that the locking member 25 is urged downward. As a result, the locking member 25 is slid downward against the force of the horizontal portion 32 of the leaf spring 30. After a further insertion of the tongue 13, the narrow neck part of the tongue 13 comes to the position in which the both sides 13*b* and 13*c* of the neck part are just above the locking portions 29*a* and 29*b* respectively. At this moment, the locking member 25 is released from the pressure of the tongue fore end exerted on the locking member to push it down against the leaf spring 30 and, therefore, the locking member 25 springs back to its uppermost starting position under the action of the leaf spring 30. Now, the rear vertical engagement surfaces of the locking portions 29*a* and 29*b* come into engagement with the anchoring fore end part 13*a* of the tongue and the desired locking of the tongue 13 is accomplished. This position is shown in FIG. 4*c*. In this locked position, if there is applied to the tongue 13 any force intending to draw it out from the locking device 1, such force is received by the material of the locking member 25 widthwise and finally by the base member 14. Therefore, this structure is capable of receiving a very strong force in this direction. Furthermore, in this embodiment, there remains present a sufficient amount of material between the two rectangular openings 20 and 21 of the base member 14 to prevent the tongue fore end part 13*a* from being deviated upward from the space 15 through the openings during the insertion of the tongue 13. If no material remained between the two openings 20 and 21 and only a larger single rectangular opening was provided in place of the two, then the fore end part 13*a* of the tongue may be moved out of the space 15 through the opening in the course of tongue insertion, because of the locking member 25 tending to move the tongue fore end part 13*a* upwardly.

As previously mentioned, in the locked position, the vertical portion 31 of the leaf spring 30 is compressed by the tongue fore end part 13*a* and therefore a large amount of restoring force can be stored in the vertical portion of the leaf spring 30.

Figure 5A:
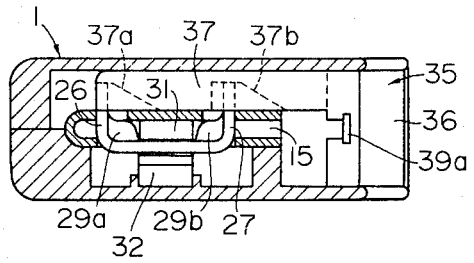
FIGS. 5*a* and 5*b* also illustrate the manner of operation of the first embodiment in transverse cross section.

A lock releasing operation is initiated by pushing the push button 35 down starting from the locked position shown in FIG. 5*a* in which the tongue 13 is omitted for the sake of clarification of illustration and only the locking mechanism 1 is shown. FIG. 5*a* clearly shows the positional relation between the two leg portions 26, 27 of the locking member 25 and the cam surfaces 37*a*, 37*b* provided on the one leg 37 of the push button in the locked position. Namely, it is seen that in the locked position the leg portions 26 and 27 of the U-shaped locking member 25 are in contact with the flat cutout areas in front of the cam surfaces 37*a* and 37*b*, respectively, so that the locking member 25 is in the position upward slide moved.

Figure 5B:
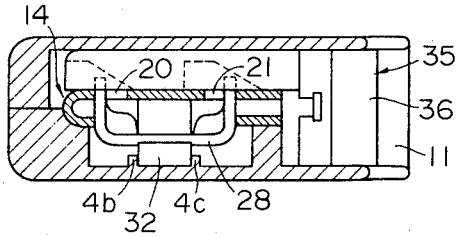
Figure 7:
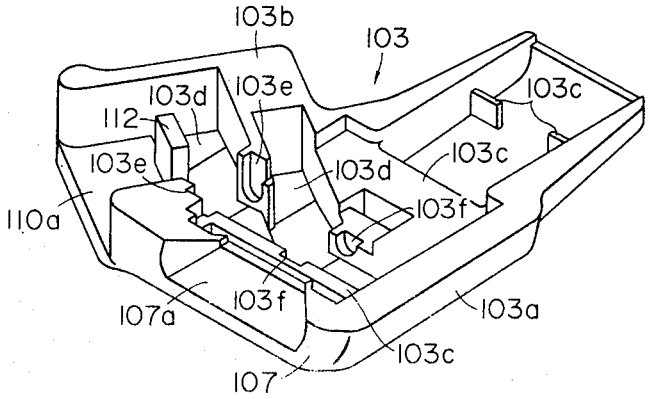
FIG. 7 is a perspective view of an upper cover member of the second embodiment showing the structure of the inside of the cover member in detail.
Figure 6:
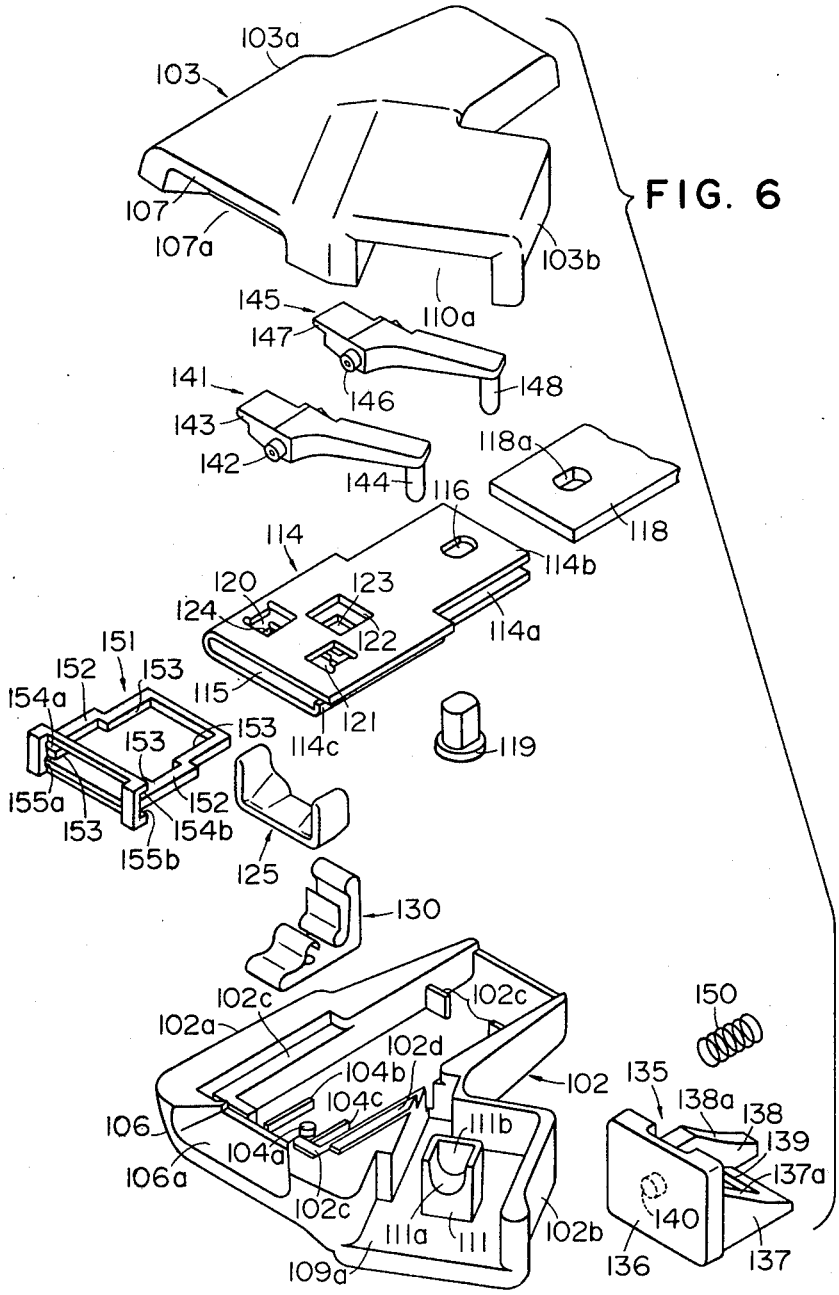
FIG. 6 is an exploded perspective of another buckle assembly showing a second embodiment of the invention.

To release the tongue 13 from the locked state, the operator pushes the button 35 inward in a direction normal to the tongue insert direction against the force of the spring 50, in the manner shown in FIG. 5*b*. As the push button 35 is moved, the leg portions 26 and 27 are pressed downward by the cam surfaces 37*a* and 37*b* of the push button. At the moment when the locking member 25 is pushed down to the position in which the rear vertical engagement surfaces of the locking portions 29*a* and 29*b* are at a level lower than the underside surface of the tongue 13, the latter springs out from the locking device 1 by the action of the leaf spring 30, more particularly, the vertical portion 31 of the spring because of the disengagement of the tongue fore end part 13*a* from the vertical engagement surfaces of the locking member. Now, the apparatus is returned to the starting position shown in FIG. 4*a*.

The locking device of the first embodiment of the invention can be assembled in the following procedure.

At first, the leaf spring 30 is placed between the two projections 4*b* and 4*c* formed in the lower cover member 2. Secondly, the push button biasing spring 50 is positioned properly. On the other hand, the connection member 18 is connected to the base member 14 and the locking member 25 is inserted into the rectangular openings 23, and 20 and 21 from the underside of the base member 14. Thereafter, the base member 14 with the locking member and connection member being connected therewith is placed in the lower cover member 2. In the lower cover member, the base member 14 is supported by the supporting surface 2*c* and the straight line portion 51 of the spring 50. The vertical portion 31 of the leaf spring 30 projects above the base member through the rectangular opening 22 of the base member 14. Then, the push button 35 is positioned with its projections 39*a*, 39*b* being fitted into the slots 9*b*, 9*c*. The two circular ends 53*a* and 53*b* are properly received in the notch 38 of the push button. The cam surfaces 37*a*, 37*b* on the underside of the one leg portion 37 of the push button is vertically aligned with the leg portions 26, 27 of the locking member 25. Lastly, the upper cover member 3 is assembled with the lower cover member 2 and they are secured to each other fixedly.

As will be understood from the foregoing, the locking device is very easy to assemble. It can be done by overlaying the components one by one. It involves no complicate step of assembling.

The above described embodiment of the present invention brings forth various advantages.

The use of the leaf spring 30 formed as one piece of spring enables the number of the necessary parts to be reduced and enables the assembly to be simplified. Although the leaf spring 30 is simple in structure, it can perform two functions, one for pushing the locking member up and the other for pushing the tongue out. According to the shown embodiment, the leaf spring 30 has a pushing force exerting on the tongue in almost the same direction as the direction of sliding movement of the tongue 13. This leaf spring is of high durability.

The inner room 5 defined by the upper and lower cover members 3 and 2 has a spare rear space available for mounting attachments to the locking device such as microswitch to inform of the locked state. It is no longer necessary to worry about the space in which such attachments are to be mounted.

A second embodiment of buckle assembly for vehicle seat belt is shown in FIGS. 6 through 9.

The second embodiment of the buckle assembly comprises a locking device generally designated by 101. The locking device 101 has two cover members, that is, an upper cover member 103 and a lower cover member 102. When assembled together, the upper and lower cover members form therein a hollow room 105 for receiving various components and members as hereinafter described. The two cover members 103 and 102 have cutouts 107*a* and 106*a* provided on the front side walls 107 and 106, respectively. When the upper and lower cover members are assembled together, the mating cutouts 107*a* and 106*a* forms together a tongue inserting opening 108 communicating to the inner room 105. The upper cover member 103 has long side walls 103*a* and 103*b* and the lower cover member 102 also has long side walls 102*a* and 102*b*. The long side walls 103*b* and 102*b* are enlarged at their front areas and cutouts 110*a* and 109*a* are provided in the enlarged areas of the side walls. These two cutouts are the same in shape and together they form a push button operating opening disposed obliquely relative to the above mentioned tongue inserting opening 108.

The two cover members have, on their corresponding inside walls, horizontally extending stepped portions 103*c* and 102*c* serving as supporting surfaces for a base member 114 as described hereinafter.

The base member 114 comprises two parallel flat plates 114*a* and 114*b* formed by bending and folding a sigle sheet of metal. Between the two flate plates 114*a* and 114*b* there is formed a tongue introducing space 115 of a thickness sufficient enough to receive the tongue 113. At the rear end part, the parallel plates 114*a* and 114*b* have bores 116 vertically aligned to each other. These bores 116 are used to connect a connection member such as an iron plate 118 with the base member 114. Through the connection member, the locking mechanism is connected to a suitable part of the vehicle body. For this end, the iron plate connection member 118 is inserted into the space 115 up to the position in which the bore 118*a* of the iron plate is in alignment with the bores 116 and is riveted in the position to the base member 114 by a rivet 119 passed through the aligned bores. The connecting method of the base member 114 with the vehicle body or the like is not limitative.

The upper flat plate 114*b* of the base member 114 has, at its front part, three nearly square bores of which two bores 120 and 121 are disposed symmetrically to guide a locking member 125. The remaining bore 122 is spaced from the two bores rearwardly and in the middle portion of the plate. The bore 122 has a size sufficient to allow the vertical portion 131 of a leaf spring 130 to pass through the bore without interference. The lower flat plate 114*a* has two bores 124 and 123. The bore 124 is a rectangular bore large enough to cover the area of the above square bores 120 and 121 in the upper plate and is vertically aligned with respect to the latter two bores. The bore 123 is of the same shape as the bore 122 in the upper plate and is vertically aligned to the latter. The lower flate plate 114*a* has also a side end surface 114*c* bent upwardly. In assembling, the side end surface 114*c* is positioned to abut against the side surface of the projection 102*d* of the lower cover member 102 so that the base member 114 can be surely fixed in the room 105. The projection 102*d* serves also to assure good and proper assembling of the upper and lower cover members 103 and 102.

The locking member 125 and the leaf spring 130 are entirely the same as the locking member 25 and the leaf spring 30 in the first embodiment in structure as well as in function and need not be further described.

To secure the leaf spring 130 to the lower cover member, there are provided again a pin-like projection 104 and two parallel elongate projections 104*b* and 104*c* on the inner bottom surface of the lower cover member 102. In assembling, the pin-like projection 104*a* is fitted into a hole formed in the leaf spring 130 and the horizontal portion of the leaf spring is inserted into the space between the two elongate projections 104*b* and 104*c*. Thus, the leaf spring 130 is secured properly in the position.

A push button generally designated by 135 is received in the hollow chamber defined by the cutout 110*a* in the upper cover 103 and the cutout 109*a* in the lower cover 102. The push button 135 comprises an exposed surface part 136, two leg portions 137, 138 extending in the direction in which the button is slid and a bridge portion 139 across the leg portions. The push button is operated by pushing the exposed surface part with a finger or the like. The leg portions 137 and 138 have inclined cam surfaces 137*a* and 138*a*, respectively, formed on their upper surfaces. The push button 135 is under the action of a compressed coil spring 150 which tends to urge the button outwardly. One end of the coil spring 150 is disposed around a pin 140 projecting from the inside wall of the push button 135 and the other end abuts the end wall 111*b* of a support block 111 standing upright on the lower cover member. The essential part of the coil spring 150 is received in a U-shaped channel 111*a* formed in the support block 111. When assembled, the top open end of the U-channel 111*a* is closed partly by a projection 112 formed in the upper cover member 103 so as to prevent the coil spring 150 from coming out from the U-channel. The upright block 111 is inserted into the space enclosed by the two leg portions 137, 138 and bridge portion 139 to prevent the push button 135 from coming out from the chamber formed by the cutouts 109*a* and 110*a*.

The significant feature of the second embodiment resides in the provision of levers 141 and 145. The levers 141 and 145 comprises, respectively, shaft parts 142 and 146, long arm parts having noses 144 and 148 and short arm parts with stepped surfaces 143 and 147. The noses 144 and 148 are disposed to engage the above described cam surfaces 137*a* and 138*a* of the push button, respectively. The stepped surfaces 143 and 147 provided at the ends of short arm parts are disposed to engage with the top ends of the two leg portions of the U-shaped locking member 125, respectively. The shafts parts 142 and 146 of the levers are received by bearing parts 103*e* and 103*f* for pivotally mounting each lever for rotation within a limited angle about the shaft in the room 105. The whole body of each the lever is contained in spaces designated by 103*d* in the upper cover member 103. Each space 103*d* has a step to prevent the lever from interferring with the upper cover during swing movement of the lever.

Designated by 151 is a tongue guide which is inserted into the space 115 of the base member 114 to guide a tongue 113. The tongue guide 151 comprises a front part having notches 154*a*, 154*b*, 155*a* and 155*b* for engagement with the front edge of the base member 114 to fix the guide to the latter, and a U-shaped part extending rearward from the front part. When the guide 151 is correctly fixed to the base member, the U-shaped part extends beyond the square bores 122, 123, The two surfaces 153, 153 opposed to each other of the narrow portion of U-shaped part serve as guide surfaces for the tongue. The locking member 125 slides passing through the wide portion 152 of the U-shaped part of the tongue guide 151.

Now, the manner of operation of the second embodiment is described with reference to FIGS. 8 and 9.

Figure 8A:
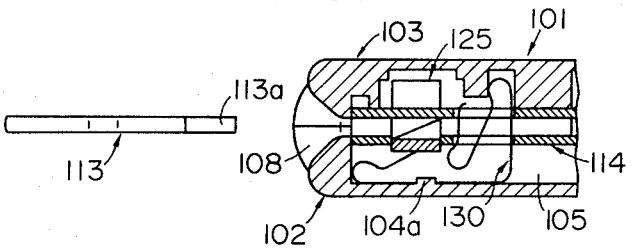
FIGS. 8*a* to 8*c* illustrate the manner of operation of the second embodiment in partial longitudinal section with the lever member and tongue guide being omitted.
Figure 9A:
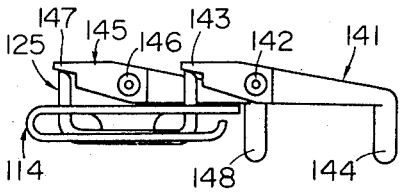
FIGS. 9*a* and 9*b* are front views of the lever member in the second embodiment illustrating the manner of operation of the lever member.

FIGS. 8*a* and 9*a* show the locking device 101 and the levers 145, 141 in their starting positions. In this position, the tongue 113 is separated from the locking device and the locking member 125 is in its upwardmost position by the action of the leaf spring 130. The leg portions of the locking member keep the levers 141 and 145 in their clockwise rotated positions through the engagement of the top ends of the leg portions with the stepped ends 143 and 147 of the short arms of the levers respectively. The locking portions of the locking member 125 are above the level of the bore 124 of the underlying flat plate 114*a* and lie in the space 115 between the two parallel flat plates of the base member 114.

Figure 8B:
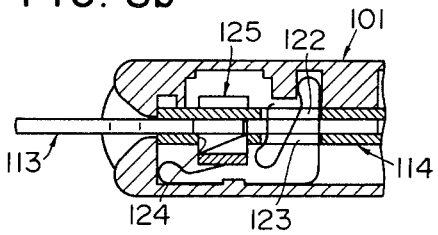
Figure 8C:
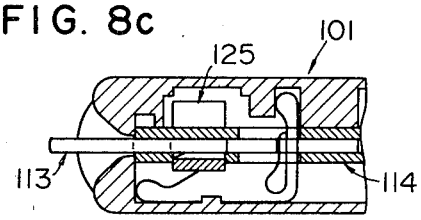

The tongue 113 may be inserted into the locking device 101 through the tongue inserting opening 108 in the manner shown in FIG. 8*b*. The insertion of the tongue 113 into the locking device 101 applies to the locking member 125 a force tending to push the latter down. Thereby, the locking member is slid downwardly against the force of the leaf spring 130. At the moment when the tongue comes to the position in which the narrow neck portion of the tongue lies just above the locking portions of the locking member 125, the pushing force exerting on the locking member 125 disappears and therefore the locking member springs up to its starting position by the force of the leaf spring 130. The rear vertical engagement surfaces of the locking portions come into engagement with the backside of the anchoring fore end part 113*a* of the tongue. Thus, the tongue is locked as shown in FIG. 8*c*. In this locked position, the vertical portion of the leaf spring 130 is compressed by the fore end part 113*a* of the tongue and a large amount of restoring force can be stored in the leaf spring.

Figure 9B:
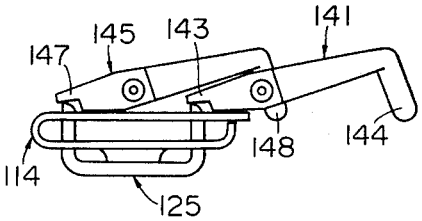

The tongue can be unlocked by pushing the push button with the operator's finger or the like. When the push button 135 is pushed, the two levers 141 and 145 are rotated about the shafts 142 and 146 counter-clockwise through the engagement of the noses 144 and 148 with the sloped cam surfaces 137*a* and 138*a* of the push button 135 as shown in FIG. 9*b*. This rotation of the levers causes the stepped ends 143 and 147 to push the locking member 125 down against the force of the leaf spring 130. At the moment when the locking member is moved downward to the position in which the rear vertical engagement surfaces of the locking portions of the locking member lie under the level of the underside of the tongue 113, the tongue is released from the locking engagement and therefore the tongue is allowed to spring out outwardly by the restoring force of the vertical portion of the leaf spring 130. After the unlocked tongue is moved back, the levers 141 and 145 and the locking member 125 return to their starting positions shown in FIG. 9*a*.

The second embodiment described above has the following advantages in addition to those which the first embodiment has.

As locking member operating means is composed of a push button and a lever mechanism, the buckle assembly is further improved in operability of the push button and disengageability of the assembly. Since the push button operating opening is disposed obliquely relative to the tongue inserting opening 108, the assembly can be incorporated into the console box of a vehicle in a preferable orientation. The operator wearing the seat belt can operate the push button conveniently in the direction normal to the exposed surface of the button. The required force applied to the push button 135 by the operator is amplified because of the lever principle and the amplified force is transmitted to the locking member. Therefore, a sure and improved unlocking action is attainable.

While the invention has been particularly shown and described with reference to preferred embodiments thereof, it will be understood by those skilled in the art that changes in the foregoing and other changes in form and details can be made therein without departing from the spirit and scope of the invention.

What I claim:

1. A buckle assembly for a vehicle seat belt comprising:

cover means comprising first and second cover members which together form a tongue inserting opening, a push button operating opening and a hollow chamber in communication with said two openings;

locking means disposed within said chamber for locking to a tongue inserted into said tongue inserting opening, said locking means comprising a base member having a tongue guide passage in communication with said tongue inserting opening and extending in the direction in which the tongue is inserted into said tongue inserting opening and guide slot means in said base member, a locking member slideably disposed for up and down movement normal to said tongue guide passage along said guide slot means, the locking member having a first part which is contacted by said tongue when said tongue is inserted into said tongue inserting opening to move said locking member along said guide slot means to an unlocking position to allow said tongue to come into a locked position and having a second part for locking to said inserted tongue at said locked position, and biasing means disposed on said cover member for biasing said locking member toward a locking position; and locking member operating means disposed between said first and second cover members and including a push button slideably mounted for movement in a plane generally parallel to the plane of the cover members within said push button operating opening.

2. A buckle assembly according to claim 1, wherein said locking member operating means comprises only a push button having thereon a cam surface in engagement with said locking member.

3. A buckle assembly according to claim 2, wherein said push button is slideable in a direction nearly normal to the tongue inserting direction and to the sliding direction of said locking member.

4. A buckle assembly according to claim 1, wherein said push button includes thereon a cam surface, and wherein said locking member operating means further comprises a lever member pivotally mounted within said cover means and having first and second lever arms, the first lever arm being in engagement with said cam surface of said push button and the second arm being in engagement with said locking member so that the sliding movement of said push button is transmitted to said locking member through said lever member to cause movement of said locking member between its locking and unlocking positions.

5. A buckle assembly according to claim 4, wherein said first lever arm is longer than the second arm.

6. A buckle assembly according to claim 4, wherein said push button is obliquely to the tongue inserting direction.

7. A buckle assembly according to claim 1, wherein said base member includes a further biasing means for biasing said tongue out of said tongue inserting opening such that when said locking member is moved from its tongue locking position to its unlocking position, said tongue may be pushed out of said tongue inserting opening by the further biasing means.

8. A buckle assembly according to claim 7, wherein said biasing means for biasing said locking member and said biasing means for pushing said tongue out of said tongue inserting opening are formed as a single leaf spring.

* * * * *